United States Patent [19]

Long

[11] 4,365,671

[45] Dec. 28, 1982

[54] WELL SYSTEM

[75] Inventor: Olen R. Long, Celina, Tex.

[73] Assignee: Otis Engineering Corporation, Dallas, Tex.

[21] Appl. No.: 211,270

[22] Filed: Nov. 28, 1980

[51] Int. Cl.[3] ..... E21B 34/14

[52] U.S. Cl. ..... 166/318; 166/239; 166/332

[58] Field of Search ..... 166/332, 318, 317, 238, 166/237, 117.5

[56] References Cited

U.S. PATENT DOCUMENTS 2,994,280 8/1961 Daffin ..... 166/333

4,230,185 10/1980 Fredd ..... 166/332

4,260,021 4/1981 Mott ..... 166/318

OTHER PUBLICATIONS pp. 24, 19, "Pumpdown Flow Controls", Pumpdown Nipples and Mandrels, *Otis Product Catalog.*

*Primary Examiner*—William F. Pate, III

*Attorney, Agent, or Firm*—Vinson & Elkins

[57] ABSTRACT

A well completion system particularly adapted for pumpdown operation in which landing of a standing valve in a foot valve automatically opens a foot valve and in which withdrawing of the standing valve automatically closes the foot valve and in which provisions are made to pump by both valves.

7 Claims, 7 Drawing Figures

WELL SYSTEM

This invention relates to well systems and more particularly to a system particularly adapted for pumpdown operations in which landing and pulling of an actuator which preferably includes a standing valve, controls the operation of the foot valve and in which improved standing valves and foot valves are provided.

PRIOR ART

Foot valves are well known. See U.S. Pat. No. 4,230,185. Pumpdown standing valves are also well known. See the Type-T Otis Standing Valve, shown in *Otis Catalog OEC*-5113A. Locking mandrels are also well known. See the Type-K Otis Locking Mandrel, page 19 of the *Otis Catalog OEC*-5113A.

It is further known to modify the Type-K plug choke shown at page 24 of *Otis Catalog OEC*-5113A to convert it from a choke to a standing valve in which tubing pressure can be increased to move the seat down and expose a bypass passageway.

Latching lugs which may be run down past obstructions but not pulled up past an obstruction without shearing a latch are also known. See U.S. Pat. No. 3,837,398.

In prior practice, particularly in pumpdown operations, it has been conventional to utilize tools in several trips to open and close foot valves and to then land or remove standing valves.

OBJECTIVES

It is an object of this invention to provide a well system particularly adapted for pumpdown operations in which in a single trip into the well a foot valve is moved between open and closed position and a standing valve is either landed or retrieved from the well.

Another object is to provide a well completion system in which in a single trip a standing valve is run into the well and during running effects opening of the standing valve to place the well in condition for production.

Another object is to provide a well completion system in which removal of the standing valve automatically closes a foot valve to protect the formation from fluid in the tubing while the standing valve is not in place.

Another object is to provide a well system in which pulling of the standing valve automatically closes a foot valve so that the well is shut-in at the producing formation in a single trip.

Another object is to provide a foot valve of the ball type in which a following seat seals on the formation side of the foot valve and in which a piston exposed to pressure across the ball valve member provides additional area exposed to well pressure for urging the seat onto the ball valve and is releasably held in position and may be released to permit pumping by the ball valve when closed by increasing tubing pressure to exert a suitable differential across the piston.

Another object is to provide a foot valve as in the preceding object in combination with a standing valve in which a bypass passageway around the standing valve can be opened in response to raising tubing pressure to a selected differential across the standing valve.

Another object is to provide a well system employing a foot valve in which the foot valve employs solid annular operating shoulders instead of collets as in the prior art and a valve operator is provided having a no-go shoulder for moving the foot valve in one direction and releasable dogs for moving the foot valve in the other direction so that the foot valve may be opened in a single pumpdown trip of the actuator and may be closed in a single return trip of the actuator.

Another object is to provide a standing valve having a nogo shoulder which will move an actuator downwardly as the standing valve is landed and having releasable dogs which will bypass obstructions as the standing valve is landed and which will be propped out during initial pulling of the standing valve to operate an actuator and which are releasable to permit continued pulling of the standing valve after the actuator has been moved.

Another object is to provide a well completion system in which a foot valve is provided in the tubing and in a single trip a standing valve may be landed or retrieved and during landing will move the foot valve to open position and during retrieval will move the foot valve to closed position and in which both the standing valve and the foot valve permit well fluids to be pumped down the tubing past each valve even though in closed position to provide for killing of the well in emergency conditions.

Other objects, features and advantages of the invention will be apparent from the drawings, the specification and the claims.

PREFERRED EMBODIMENT

In the drawings wherein an illustrative embodiment of this invention is shown,

Figures 1A, 2A:
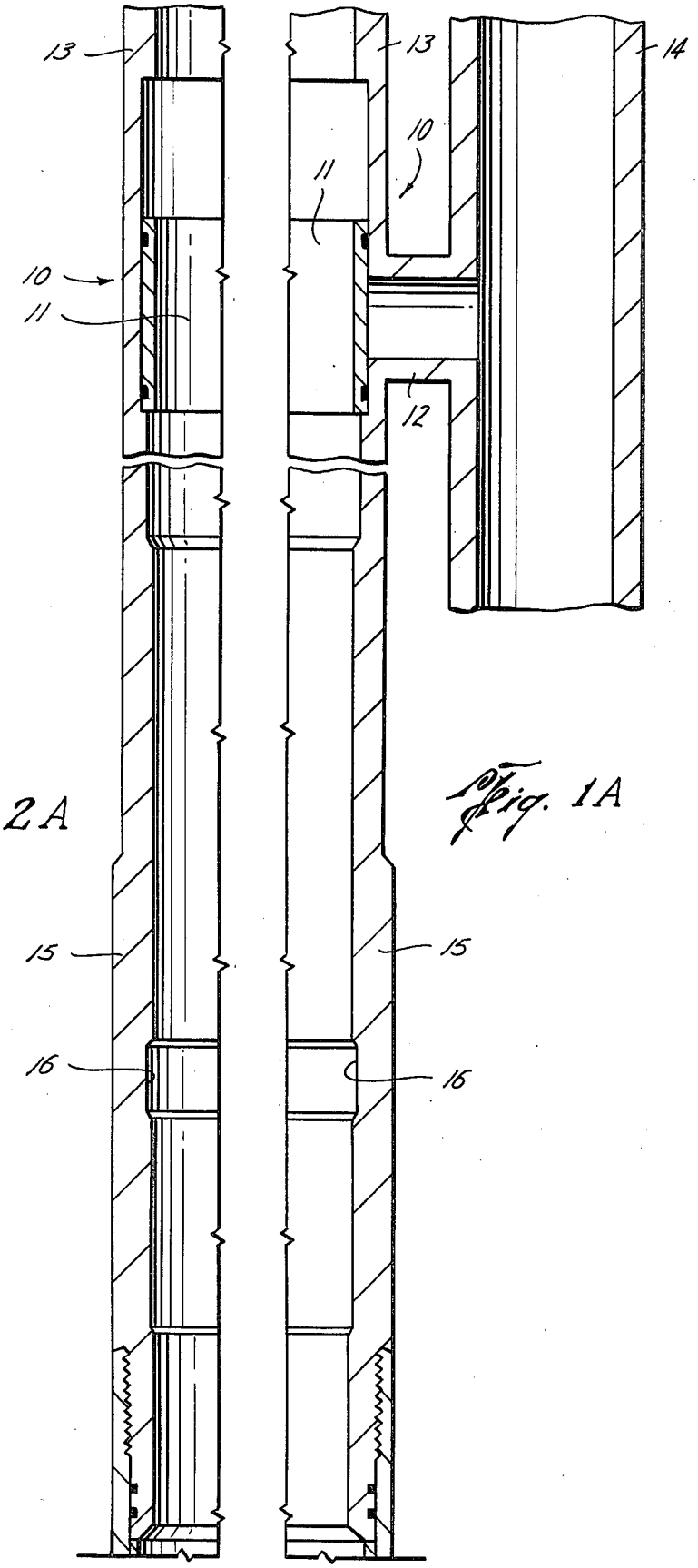
FIGS. 1A and 1B are continuation views in vertical quarter section through the lower end of a well tubing showing the foot valve of this invention in closed position.
FIGS. 2A and 2B are views similar to FIGS. 1A and 1B showing the foot valve in open position.
Figure 1B:
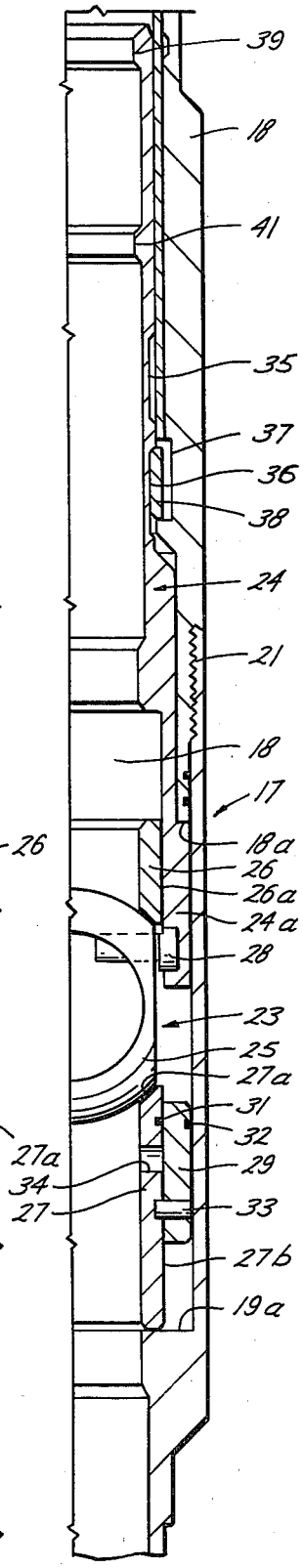

Referring first to FIGS. 1A and 1B, a H-member indicated generally at 10 is controlled by a slide valve 11. This H-member may take any desired form such as that shown at page 13 of the above identified Otis Catalog. While the invention may be utilized with wireline equipment it is particularly adapted for pumpdown procedures and such procedures normally utilize a H-member such as H-member 10 so that with the H-cross-connector 12 in open condition U-tube of fluids through the two legs 13 and 14 of the H-connector which are connected to the tubing in the well will permit pumpdown procedures to be effected in the well. With the cross-connector 12 closed by valve 11 as shown, the system may be utilized to produce through two separate formations or to produce through a single formation while other operations are carried out through the other tubing, such as gas lift or the like.

The foot valve and standing valve completion systems of this invention may be utilized in one or both of the tubings in the system, but only one system is shown in the drawing and the other tubing may be completed in the same manner or in any other desired manner.

Depending from the H-member 10 is a nipple 15 having an internal groove 16 for receiving a locking mandrel.

Depending from the nipple 15 is a foot valve indicated generally at 17. The foot valve has upper and lower body sections 18 and 19 suitably secured together as by the thread system 21 and sealed by seals 22.

Within the foot valve body there is provided a ball valve and seat indicated generally at 23 and an actuator for the ball valve indicated generally at 24.

Referring first to the ball valve 23, the ball valve member 25 is supported for rotation between an upper tubular retainer 26 and a lower tubular seat 27.

The upper tubular retainer is conventional in form and has an outer diameter slightly less than the inner diameter of the bore 27 through the lower body section 19 and abuts shoulder 18*a* on the lower end of body section 18. The upper retainer 26 has flats 26*a* on opposite sides providing a space through which the actuator arms 24*a* of the actuator 24 extend and reciprocate. The arms 24*a* each carry pins 28 which cooperate with the ball valve member 25 in the conventional manner to rotate the ball valve member.

The seat 27 is held between the ball valve member 25 and an upwardly facing shoulder 19*a* in the lower body section 19. The upper surface 27*a* of the seat member 27 provides a valve seat cooperable with the valve member to control flow through the valve body in the conventional manner.

In accordance with this invention a bypass is provided to permit pumping by the ball valve when in closed position. This bypass preferably also provides additional pressure responsive area exposed to formation pressure to provide a larger area effective to urge the valve seat 27 into engagement with the ball 25. In the preferred form of the invention a piston 29 is reciprocal in the bore 19*b* of body section 19 and is slidably carried on the outer surface 27*b* of the valve seat 27. A suitable seal such as O-ring 31 seals between the piston 29 and the valve seat 27. A similar seal such as O-ring 32 seals between the piston 29 and the body section 19. In normal operation of the valve the seat 27 and piston 29 float together in response to the pressure differential thereacross as they are pinned together by the shear pin 33.

In the event it is desired to pump past the closed foot valve, such as under emergency conditions, the tubing pressure may be increased to a selected differential over the formation pressure which will shear the pin 33 and drive the piston 29 downwardly to uncover seal 31. This will permit fluid to be pumped by the seat 27. Preferably, a flowway, such as ports 34, is provided in the seat 27 to provide for free flow of fluid past the valve seat under these conditions.

Referring now to the actuator 24, it is reciprocal within the body sections 18 and 19 and is provided with a pair of external grooves 35 and 36. The body section 18 has an internal groove 37 in which there is positioned a detent ring 38. The detent 38 cooperates with the two grooves 35 and 36 to detent the actuator 24 in each of its valve open and valve closed positions.

The actuator is provided internally with substantially continuous shoulders which may be engaged to move the actuator between open and closed positions. These shoulders should be rigid to avoid the problems of bending which may be experienced with collets. Preferably, the shoulders are provided by spaced upper internal flange 39 and lower internal flange 41. As will appear more clearly hereinafter, the upper flange 39 provides a no-go shoulder which may be engaged by a no-go shoulder on a shifting tool to move the foot valve to open position. The flange 41 provides a shoulder which may be engaged by an actuator to move the foot valve to closed position. Two flanges 39 and 41 are provided for convenience in design of the preferred shifting tool.

The foot valve is shown in the right quarter section to be in closed position and it will be noted that the detent ring 38 cooperates with groove 36 to detent the foot valve closed. The left hand quarter section shows the foot valve in open position and the ring 38 cooperates with groove 35 to detent the foot valve in open position.

Figure 3:
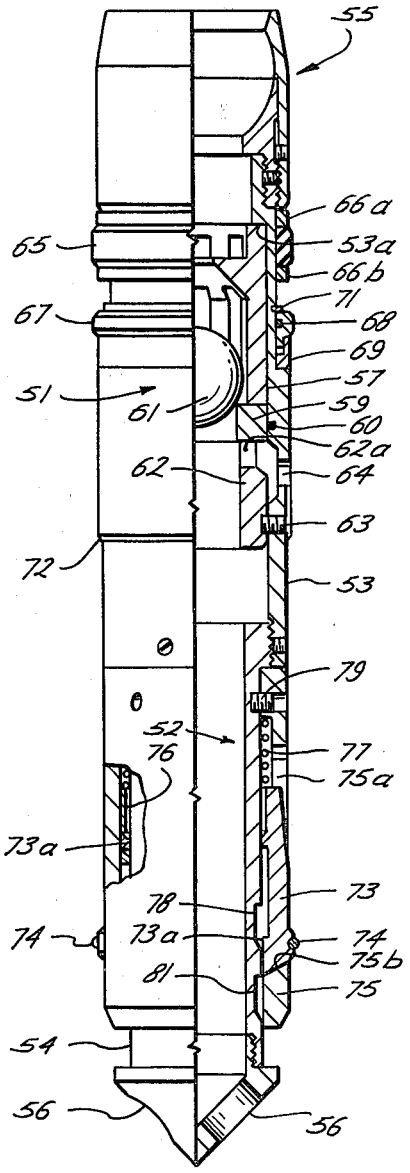
FIG. 3 is a view partly in elevation and partly in a quarter section illustrating a valve operator including a back check valve constructed in accordance with this invention.

Reference is now made to FIG. 3 in which a preferred form of foot valve shifting tool which includes a standing valve is illustrated.

The standing valve is indicated generally at 51 and the shifting tool for the foot valve is indicated generally at 52. The assembly includes an upper body 53 and lower body 54. At the upper end of body 53 there is shown generally a swivel socket 55 which may take any desired form. At the lower end of the body is a ported nose 56.

Referring first to the back check valve, a cage 57 is positioned in the body against body shoulder 53*a* in body 53. The cage has an inwardly directed ball retained 58. Arranged below and abutting the cage is the seat ring 59 which is slidable within the bore of the upper body section 53 and a suitable seal such as O-ring 60 seals between the body and the seat. The ball 61 cooperates with the seat to act as a check valve in the usual manner of a standing valve. Below the seat ring 59 there is provided a seat retainer 62 having ports 62*a* adjacent the seat ring 59. The retainer 62 is pinned to the body 53 by shear pins 63 and holds the seat ring and ball cage in position during normal operation of the standing valve. The body 53 is provided with ports, such as 64, at a position below the seat ring 59. If at any time it is desired to pump by the standing valve a suitable tubing pressure may be exerted to impose a selected differential across the seat ring 59 to shear pin 63. When this occurs the seat ring will move downwardly to disengage the O-ring 60 and permit fluid to bypass the seat and pass through ports 64 and 62*a* in a downwardly direction.

A suitable seal is provided on the exterior of the standing valve for engagement with the structure in which it is landed. This seal may be provided by seal member 65 between spacers 66*a* and 66*b*. To protect the seal a split wear ring 67 is provided which is centralized and urged to expanded position by the O-ring 68. The split ring is held between a retainer 69 and a snap ring 71.

The shifting portion 52 of the tool includes a shoulder for moving a tool such as the foot valve actuator to open position. This shoulder may be provided by the no-go shoulder 72 on the exterior of the body section 53. In accordance with the objective of this invention of eliminating any collet fingers which may bend, the shoulder 72 is a full circumferential downwardly facing surface designed to cooperate with a similar upwardly facing surface, such as that provided by the inner flange 39 on the foot valve actuator 24.

The shifting section 52 includes a means which will collapse when encountering an obstruction in the well, such as an internal flange, as it is moving in a downward direction, but which will engage such an obstruction when the tool is moving in an upward direction. Any suitable type of lugs could be utilized for this purpose and the disclosure of the above identified U.S. Pat. No. 3,837,398 is incorporated herein in its entirety as illustrating one form of lug system which could be utilized.

In accordance with the preferred embodiment of this invention, a plurality of lugs 73 are employed. These lugs include wear member 74. The lugs are carried by the lug retainer 75 slidably mounted on body section 54. The lugs are reciprocal longitudinally of the tool within slots 75*a* within the lug retainer. The lugs 73 include circumferentially extending ears 73*a* which are positioned in circumferentially extending slots in the ring 76. The ring 76 is held between the lug carrier 75 and body 54.

Suitable resilient means such as spring 77 is positioned between a shoulder on the retainer 75 and dogs 73 and urges the dogs 73 along with their ring 76 toward down position. The ring insures that the several dogs move together. In the down position the lower ends of the dogs abut against a shoulder 75*b* at the lower end of slots 75*a*.

The body 54 is provided on its exterior surface with a groove 78 into which an internal flange 73*b* on each lug is received when the lugs are moved upwardly and inwardly relative to the body 54. As soon as the force causing this action is removed the spring 77 returns the dogs to their lower position as shown so that they are in position for engaging a shoulder as the structure moves through the well tubing. Thus, the standing valve-actuator can be moved to a position at which the wear members 73*a* on the lugs ae below the shoulder 41 on the foot valve and are in a position to engage this shoulder as the standing valve is withdrawn from the foot valve.

After the foot valve has been shifted provisions are made on the standing valve-shifting tool to release the foot valve and permit the standing valve-shifting tool to be withdrawn from the hole. In the illustrated embodiment this is provided by securing the lug retainer 75 to the body 54 by shear pin 79. When this pin is sheared, the entire lug retainer moves downwardly and the flange 73*b* on the lugs will be depressed into a second groove 81 on the body 54 to permit the lugs to retract and release from the foot valve to permit the standing valve to be withdrawn from the hole.

Figure 4A:
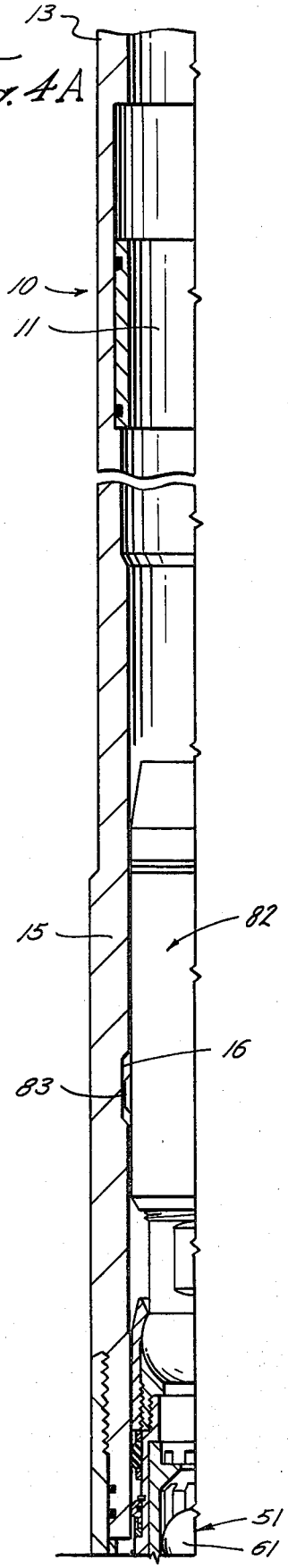
FIGS. 4A and 4B are continuation quarter section views showing the foot valve in open position as in FIGS. 2A and 2B, and showing in quarter section the standing valve landed to latch the foot valve in open position with the locking mandrel latched in place to lock the standing valve in the well with the locking mandrel shown in quarter section elevation.
Figure 4B:
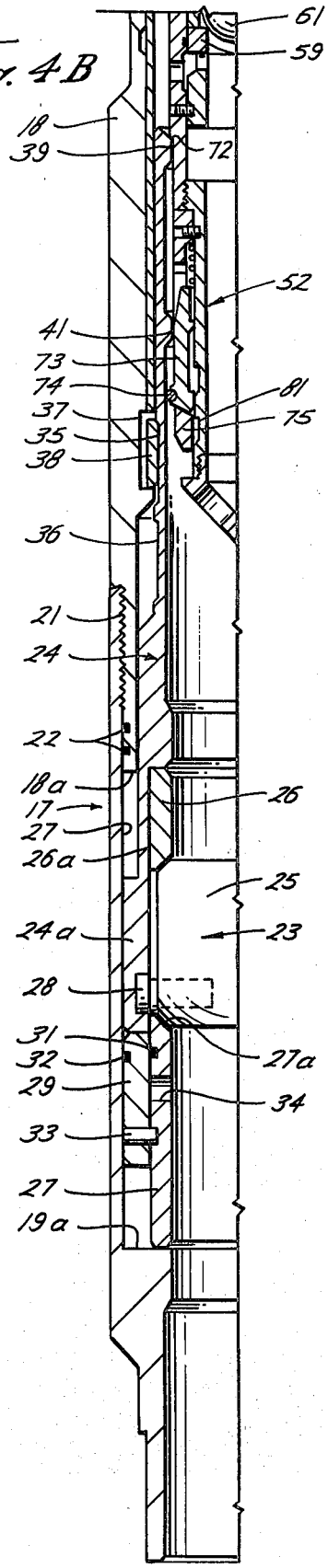

Referring now to FIGS. 4A and 4B, the structures of FIGS. 1 and 3 are shown together and there is additionally shown a locking mandrel 82 having locking lugs 83 cooperating with the internal groove 16 in the landing nipple. The details of the locking mandrel are not shown as any desired locking mandrel may be utilized. For instance, the Type-K Locking Mandrel shown at page 19 of the above identified Catalog may be utilized. The locking mandrel should, of course, have a bore therethrough to provide for free flow of fluids.

OPERATION

In the use of the system illustrated, the foot valve 17 will be made up on the lower end of one or both of the tubing strings in the well. The foot valve can be used with a single string, if desired. In the illustration two strings are shown and the foot valve may be included in one or both of the well tubings.

The well will be placed in condition for pumpdown operations by first conditioning the H-member for cross-flow between the two tubings as by opening the slide valve 11. To avoid the fluid used in pumpdown operation causing fluid to be driven into the producing formation, it is preferred that the foot valve be in the closed position and the slide valve 11 be in open position to permit U-tubing of fluids during pumpdown. With the slide valve in open position a train of pumpdown tools made up in the manner well understood by those skilled in the art is pumped down into and through the H-member 10 and into the foot valve. The locomotive or pump piston will, of course, at all times be above the H-member so that a reversal of fluid flow will return the train to the surface. As will be understood by those skilled in the art, the train will be releasably latched to the locking mandrel 82. As the train moves downwardly within the foot valve, the no-go shoulder 72 on the standing valve-shifting tool will engage the flange 39 on the foot valve actuator 24 as shown in FIGS. 3A and 3B and will force the actuator 24 downwardly to move the foot valve element 25 to full open position. At this time the lugs 73 will have moved past the actuator flange 41 as shown. The train is released from the lock mandrel 82 and withdrawn from the hole. Thereafter, if desired, the H-member may have its sleeve valve 11 moved to closed position. It will be understood that the showing of the sleeve valve 11 is schematic and the sleeve valve 11 may be shifted in any of the well known manners, such as by mechanical shifting with a tool on a pumpdown train or by use of a pressure responsive valve which controls flow through the cross-connector 12.

At this time the well is ready for production and may be produced in the usual manner. If any emergency arises and it is desirable to kill the well, pressure within the tubing may be increased to a value which will shear the pin 63 in the standing valve and permit kill fluids to be introduced into the tubing.

When it is desired to pull the standing valve a suitable pump train is run into the well to engage the locking mandrel 82 and withdraw the locking fingers from groove 16. Then the locomotive may be moved up the well and in doing so the latch fingers 73 will engage the inner flange 41 on the actuator 24 and move the actuator to the up position in which the detent 38 engages the actuator groove 36 as shown. At this time the ball valve 25 is in closed position and the well is shut-in at the foot valve. Further upward force exerted on the locomotive will result in shearing of pins 79 which will release the lugs 73 and permit them to drop into grooves 81 at which point they are sufficiently retracted to disengage the internal actuator flange 41 and permit the standing valve to be withdrawn from the foot valve leaving the foot valve in closed position.

If at any time while the foot valve is closed it is desired to kill the well, fluid pressure may be increased in the tubing to provide a selected differential across the foot valve member 25 which will shear pin 33, permitting the piston 29 to move downwardly uncovering seal 31 to permit fluids to bypass through ports 34, thus providing for kill fluid to be pumped into the tubing. It will be appreciated that this feature of the foot valve will normally only be used in emergency conditions as the foot valve is thereafter inoperative and the string must be pulled to redress the foot valve.

Figure 2B:
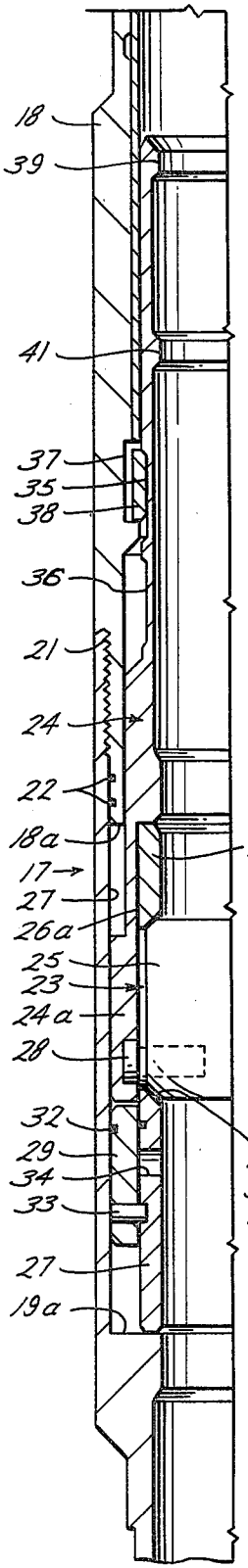

The standing valve may be run into and removed from the well at the desire of the operator and the actuator portion of the tool shown in FIG. 2 may be utilized to control the position of the foot valve without utilizing the standing valve, if desired.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A well completion system comprising:

a foot valve including;

a body having a bore therethrough, a valve member and seat controlling flow through the bore, an actuator positioning the valve member in open position when the actuator is moved to down position and positioning the valve member in closed position when the actuator is in up position, and upwardly and downwardly facing rigid shoulders on said actuator;

a standing valve in said foot valve including; a body positioned in the bore of the foot valve, a valve member and seat permitting upward flow through the body and preventing downward flow through the body, seal means on the exterior of the body sealing between the standing valve and the foot valve body, downwardly facing no-go shoulder means on the standing valve body engageable with the upwardly facing shoulder on the foot valve actuator to move the foot valve to open position as the standing valve is landed in the foot valve, upwardly facing means on the standing valve body engageable with said downwardly facing shoulder on the foot valve actuator for moving the foot valve to closed position as the standing valve is withdrawn from the foot valve, said upwardly facing means provided by lugs movable between retracted and extended position as the standing valve is inserted into the foot valve bore to permit the lugs to move past the downwardly facing shoulder on the actuator, means holding said lugs in extended position engaging said downwardly facing shoulder during upward movement of the standing valve and foot valve until the foot valve is moved to closed position, and releasing means releasing the lugs to move to a retracted position upon continued upward movement of the standing valve to withdraw the standing valve from the foot valve.

2. The well completion system of claim 1 wherein, both the standing valve and the foot valve are provided with bypass means permitting fluid to bypass the valve members in a downwardly direction when in closed position in response to selected downward pressure differentials applied across each valve member.

3. A standing valve comprising, a body, seal means on the exterior of the body, a downwardly facing no-go shoulder on the body, a valve seat and ball in the body permitting upward flow through the body and preventing downward flow through the body, latch means carried on the body having lugs movable between retracted and extended positions as the valve is moved downwardly in a tubing, resilient means urging said lugs toward extended position, means including releasable holding means preventing retracting of said lugs in response to upward movement of the valve in a tubing until said holding means is released, and pressure responsive means releasably securing said seat in the body and when released rendering said seal means ineffective to permit downward flow through the body.

4. The valve of claim 3 wherein the holding means is a shear pin means.

5. A foot valve comprising, a body, a ball valve member mounted for rotation in the body, an actuator slidable in the body and cooperable with the ball valve member to rotate it between open and closed positions, an annular seat below the ball valve member and cooperable therewith to control flow through the valve, an annular piston slidably mounted between the body and seat, seal means between the seat and piston and between the piston and body, and pressure responsive means releasably securing the piston to the valve seat, said piston providing a pressure responsive area normally urging said seat toward said ball valve member when the ball valve member is in closed position and movable in response to releasing of said securing means to a position rendering the seal means between the seat and piston ineffective to permit fluid to bypass said ball valve member and seat.

6. The valve of claim 5 wherein a port is provided in the seat on the side of the piston-seat seal means remote from the ball valve member.

7. A well completion system comprising: a foot valve including;

a body having a bore therethrough, a valve member and seat controlling flow through the bore, an actuator positioning the valve member in open position when the actuator is moved to down position and positioning the valve member in closed position when the actuator is in up position, upwardly and downwardly facing rigid shoulders on said actuator;

means for shifting the actuator of said foot valve including;

a body positioning in the bore of the foot valve, downwardly facing no-go shoulder means on the body engageable in abutment with the upwardly facing shoulder on the foot valve actuator to move the foot valve to open position with downward movement of the shifting means, upwardly facing means on the shifting means body engageable with said downwardly facing shoulder on the foot valve actuator for moving the foot valve to closed position as the standing valve is withdrawn from the foot valve, said upwardly facing means provided by lugs movable between the retracted and extended positions as the shifting means is inserted into the foot valve bore to permit the lugs to move past the downwardly facing shoulders on the actuator, means holding said lugs in extended position engaging said downwardly facing shoulder during upward movement of the shifting means and foot valve until the foot valve is moved to closed position; and releasing means releasing said lugs to move to a retracted position upon continued upward movement of the standing valve to withdraw the standing valve from the foot valve.

* * * * *